United States Patent [19]

Kaji et al.

[11] 4,081,717

[45] Mar. 28, 1978

[54] ZIGZAG SHIFTING SELF-TRANSFER TYPE DISPLAY DEVICE

[75] Inventors: Tetsunori Kaji, Kanagawa; Atsushi Sumioka, Hachioji, both of Japan

[73] Assignee: Hitachi, Ltd., Japan

[21] Appl. No.: 755,995

[22] Filed: Jan. 3, 1977

[30] Foreign Application Priority Data

Jan. 12, 1976 Japan ..... 51-2076

[51] Int. Cl.[2] ..... H01J 61/10; H05B 41/00

[52] U.S. Cl. ..... 315/169 TV; 313/190; 313/220

[58] Field of Search ..... 315/169 TV, 169 R; 340/324 M

[56] References Cited

U.S. PATENT DOCUMENTS 3,976,993 8/1976 Hirose et al. ..... 315/169 TV X

*Primary Examiner*—Alfred E. Smith
*Assistant Examiner*—Charles F. Roberts
*Attorney, Agent, or Firm*—Craig & Antonelli

[57] ABSTRACT

A display device wherein a plurality of discharge cells exploiting the d.c. discharge and having the memory function are separated into a group of cells to be used only for the transfer of discharge and a group of cells to be used for the transfer of discharge and for the display of characters etc., and wherein the self-transfer of discharge is done while the discharge is shifting zigzag among the cells of both the groups.

2 Claims, 20 Drawing Figures

ZIGZAG SHIFTING SELF-TRANSFER TYPE DISPLAY DEVICE

BACKGROUND OF THE INVENTION

1. Field of the Invention

This inventin relates to a flat display device which replaces a cathode ray tube, and more particularly to a display device which employs optical elements having the memory function.

2. Description of the Prior Art

Heretofore, cathode ray tubes have been mainly used in a television set, the output device of a computer, the display device of a measuring instrument, etc., but flat display devices have been investigated and developed in compliance with the request for, e.g., the miniaturization of the device. These devices are so constructed and operated that a large number of light emitting elements such as electric bulbs, electroluminescence elements, light emitting diodes and discharge elements; optical modulator elements made of liquid crystal or the like; or elements whose optical states are changed by inputs (in this specification, the above-mentioned elements are generically named "optical elements") are principally arranged on a plane in the form of a matrix, and that a picture is displayed by applying electric signals to the individual optical elements and thus changing the optical states of the optical elements constituting a picture frame.

As one of the expedients for obtaining a bright picture with such flat display device, it is known to employ as the optical elements ones which have the memory function as will be described later.

In the case of driving such flat display device, the fundamental driving method has the disadvantage that the number of driving circuits and the number of connections between the driving circuits and electrodes are enormous. By way of example, consider a character display device of 32 characters × 8 lines and of 7 × 9 dots per character. At this time, the number of driving circuits and the number of connections become close to 300. When the number of driving circuits is so large, the cost rises, and when the number of connections is so large, the reliability lowers.

There has been published a self-transfer type display device which employs optical elements having the memory function in order to enhance the brightness and which adopts means stated hereunder in order to diminish the number of driving circuits and the number of connections. For the sake of simplicity, the optical elements shall be hereinbelow termed the "cells."

FIG. 1 schematically shows the connections between cells and electrodes in a prior-art device. Here, the cells $a_w$, $a_1$, $a_2$, $a_3$, . . . have the memory function. The cell in each of display devices having hitherto been published has an equivalent circuit in which a capacitor and a discharge element are connected in cascade as shown in FIG. 2*a*, one in which a resistance and a discharge element are connected in cascade as shown in FIG. 2*b*, or one in which a resistance exhibited by a discharge element itself (for example, the abnormal glow-discharge region) is employed without using the external resistance in FIG. 2*b* as shown in FIG. 2*c*. Alternatively, the cell is an electroluminescence element, a light emitting diode of the P-N-P-N structure, or the like.

As illustrated in FIG. 3, such cell has a hysteresis characteristic in the brightness versus the electric variable value $x$ (for example, voltage amplitude, current amplitude, pulse interval, pulse width, or pulse period). There is a region in which two states $B_1$ and $B_o$ or more states of brightness exist with respect to a certain value (light emission maintaining value) $x_S$ of the variable value. Here, $x_E$ denotes the minimum value for maintaining the light emission (minimum light emission maintenance voltage), and $x_W$ the minimum value for starting the light emission (minimum discharge starting voltage).

The cell of the self-transfer type display device requires (1) to have the memory property as described above and (2) to have coupling means between the cells. In the following explanation, the discharge cell shown in FIG. 2*c* will be referred to as such cell. It is a matter of course, however, that the invention is applicable to any cells fulfilling the above-mentioned two conditions (for example, the cells in FIGS. 2*a* and 2*b*).

FIG. 4 illustrates a characteristic obtained in such a way that ionization means, for example, coupling holes are provided between the cells, i.e., between $a_w$ and $a_1$, between $a_1$ and $a_2$, between $a_2$ and $a_3$, . . . in the prior-art device shown in FIG. 1, and that the values of the discharge starting voltage $x_W$ at which the cells emitting no light are put into the light emission are plotted versus the distance between the cell emitting light and the cell not emitting light. In this case, $x_{W1}$ and $x_{W5}$ denote the discharge starting voltages of the first and fifth cells, respectively, $x_S$ denotes the light emission maintaining voltage, and $x_E$ denotes the minimum light emission maintaining voltage.

In the panel provided with the coupling means between the cells as described above, every fourth ones of cathodes $K_1$, $K_2$, $K_3$ . . . of the respective cells $a_1$, $a_2$, $a_3$ . . . are connected to cathode lines as shown in FIG. 1. Voltages $V_{K\phi1}$, $V_{K\phi2}$, $V_{K\phi3}$ and $V_{K\phi4}$, $V_{KW}$, and $V_A$ of waveforms shown in FIG. 5 are respectively applied to the four phases of cathode lines $K_{\phi1}$, $K_{\phi2}$, $K_{\phi3}$ and $K_{\phi4}$, a writing cathode line $K_W$, and an anode line A. Here, those parts in the voltage waveform $V_{KW}$ which are indicated by marks X change in dependence on contents to be displayed. First, using the voltage indicated by the mark X, the writing cell $a_W$ is caused to emit light, to perform the writing. Subsequently, using the four phases of cathode pulse voltages $V_{K\phi1} \sim V_{K\phi4}$, the point of light emission is sequentially transferred. In FIG. 5, both $E_{A1}$ and $E_{A2}$ designate anode voltages. The voltage $E_{A2}$ is applied in superposition on the voltage $E_{A1}$ in order to facilitate the shift or transition of the discharge (the same applies in the following description). At the time when a desired cell is caused to emit light, the transfer (whose direction is indicated by an arrow in the figure) is stopped and the display is performed. Among the cells in FIG. 1, those $a_2$, $a_3$, $a_4$, $a_6$ . . . which are hatched do not execute the display even when they emit light, and execute only the transfer. On the other hand, the cells $a_1 a_5$, $a_9$, . . . act as the cells for the display (hereinafter, termed "dots") and also effect the transfer action.

According to the self-transfer type display device of FIG. 1 thus constructed, however the cathode electrodes $K_N$ ( N = 1, 2, . . . ) may increase, the number of lead-out electrodes may be 6. In contrast, in the conventional matrix panel, the number of lead-out electrodes increases with the number of cathode electrodes $K_N$.

In the case of the four-phase drive illustrated in FIG. 1, the interval of the displaying cells in the direction of self-transfer, i.e., the dot pitch (for example, the interval between the cells $a_1$ and $a_5$) $l_d$ becomes four times larger than the pitch of the cells (for example, the interval between the cells $a_5$ and $a_6$) $l_c$. The pitch of the cells has its lower limit determined by the precision of fabrication, etc. Regarding, for example, the AC type plasma cell shown in FIG. 2a, the limit of the pitch $l_c$ of the cells is 0.4 mm at the present. For this reason, in the case of the prior-art device which is subjected to the four-phase drive in the electrode arrangement of FIG. 1, the limit of the dot pitch $l_d$ at the display becomes 1.6 mm. In the case where, on account of the response speed of the cells, a dispersion in the characteristics, etc., the number of drive phases of the cathodes need be increased to five or more, the dot pitch becomes still greater.

In the case of performing a character display of the desk top type, a value of 0.7–1 mm is required as the dot pitch $l_d$ at the display. The prior-art self-transfer type display device has therefore been inappropriate for a display device of the desk top type in spite of the fact that it is high in brightness and small in the number of driving circuits as well as the number of connections.

SUMMARY OF THE INVENTION

It is an object of this invention to provide a display device which is useable as a desk top type display panel and whose brightness is high.

Another object of this invention is to provide a display device in which driving circuits are simple and the number of connections is small.

In order to accomplish such objects, this invention creates a structure wherein a first set of electrodes are driven by $n$ phases ($n$ denotes an integer satisfying $n \geqq 2$), a second set of electrodes intersecting with the first set of electrodes are driven by $m$ phases ($m$ denotes an integer satisfying $m \geqq 2$), and the transfer of discharge by cells is carried out zigzag relative to a desired direction of transfer (hereinafter, termed the "principal self-transfer direction").

In this case, the operation corresponds to a drive by $m \times n$ phases in the case of the prior-art device. For this reason, the dot pitch $l_d$ at the display in the self-transfer direction is $m \times n \times l_c$ in the prior-art device, whereas the dot pitch $l_d$ at the display in the principal self-transfer direction becomes $m \times l_c$ under substantially equal operating conditions in this invention. For example, in the case where $m = n - 2$, according to this invention the dot pitch at the display in the principal self-transfer direction becomes a half of that in the prior-art device (of course, the cell pitches in the invention and the prior art are equal).

Hereunder, in order to simplify the explanation, the case of $m = n = 2$ will be referred to. However, this invention is not restricted thereto, but it is generally applicable to cases where $m \geqq 2$ and $n \geqq 2$.

DESCRIPTION OF THE PREFERRED EMBODIMENTS

Figure 6:
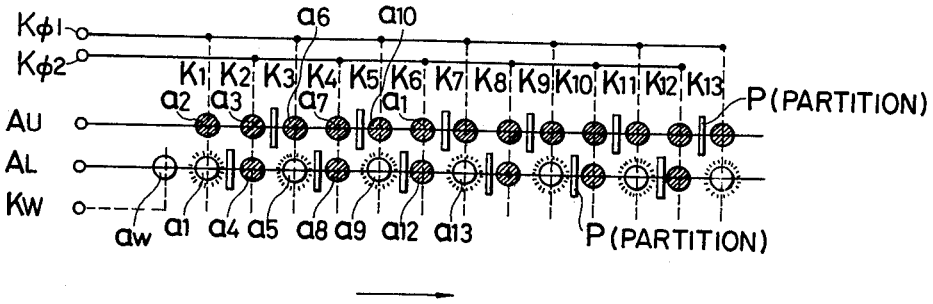
FIGS. 6, FIGS. 11a and 11b, and FIG. 13 are schematic views each showing the connections between optical elements and electrodes in a display device of this invention.

FIG. 6 is a diagram showing an example of the connections between cells and electrodes which constitute the self-transfer type display device according to this invention.

Figure 1:
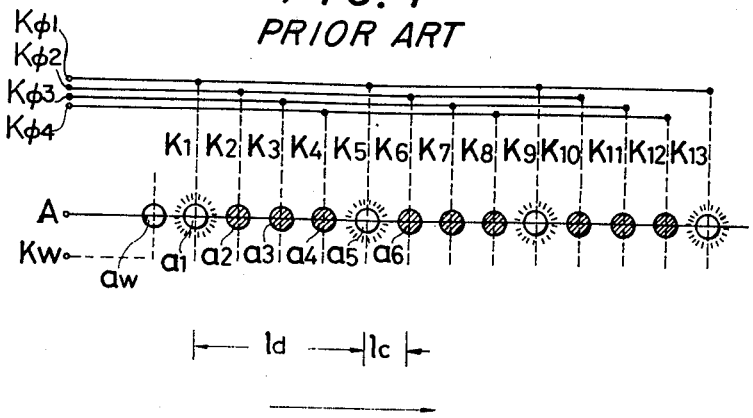
FIG. 1 PRIOR ART
FIG. 1 is an explanatory view schematically showing the connections between optical elements and electrodes in a prior-art display device.
Figures 2A, 2B, 2C:
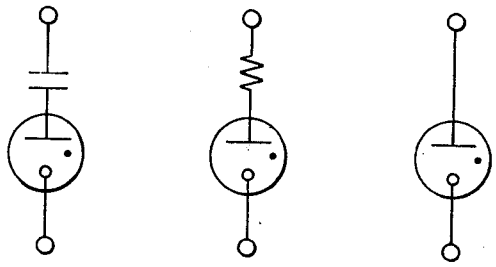
FIGS. 2a, 2b and 2c are explanatory views each showing an example of an optical element which is applicable to this invention.
Figure 3:
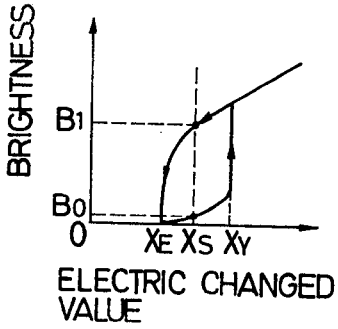
FIG. 3 is a curve diagram showing an example of the memory characteristic of the optical element.
Figure 4:
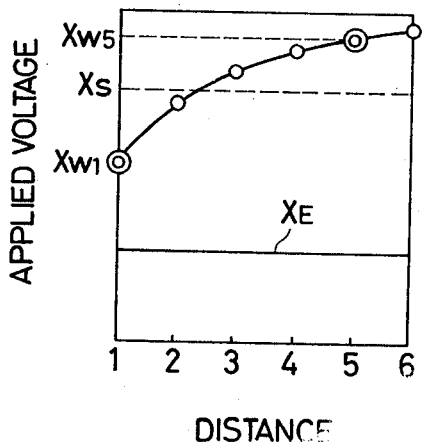
FIG. 4 is an explanatory view showing an example of the characteristic of ionization coupling between the optical elements.
Figure 5:
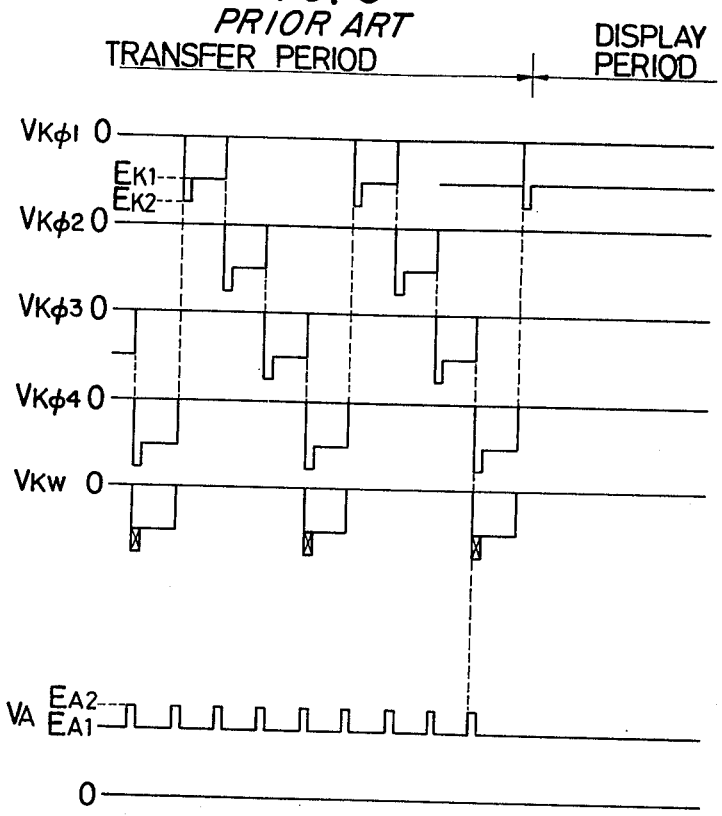
FIG. 5 PRIOR ART
FIG. 5 is a diagram of the driving waveforms of the prior-art device.

As in the case of FIG. 1, symbols $a_w$, $a_1$, $a_2$, $a_3$, . . . represent the cells all of which have the memory function and among which those $a_2$, $a_3$, $a_4$, $a_6$, $a_7$, $a_8$, . . . are employed for only the transfer and those $a_1$, $a_5$, $a_9$, . . . are employed for both the transfer and the display. Here, means of ionization coupling are provided between the cells $a_w$ and $a_1$, between the cells $a_1$ and $a_2$, between the cells $a_2$ and $a_3$, between the cells $a_3$ and $a_4$, between the cells $a_4$ and $a_5$, . . . The degree of coupling is made smaller between the cells $a_1$ and $a_4$, between the cells $a_3$ and $a_6$, between the cells $a_5$ and $a_8$, between the cells $a_7$ and $a_{10}$, . . . than between the cells (between the cells $a_w$ and $a_1$, between the cells $a_1$ and $a_2$, . . . ) as illustrated by partition plates P in the figure. The first set of electrodes (first anode electrode $A_U$ and second anode electrode $A_L$) are arranged substantially in parallel with the principal self-transfer direction, while the second set of electrodes ($K_{\phi 1}$, $K_{\phi 2}$) are provided in a direction substantially orthogonal to the first set of electrodes.

Figure 7:
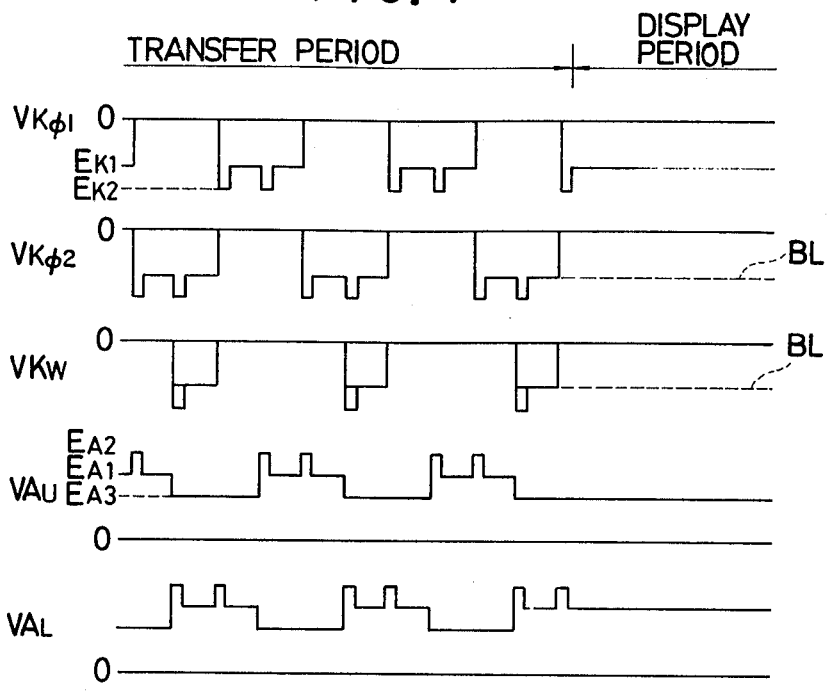
FIG. 7, FIGS. 8a–8d, and FIG. 14 are diagrams each showing an example of the driving waveforms in the display device of this invention.

FIG. 7, shows waveforms of appled voltages to the cathodes in two phases, $V_{K\phi 1}$ and $V_{K\phi 2}$; waveforms of applied voltages to the anodes in two phases, $V_{AU}$ and $V_{AL}$; and a waveform $V_{KW}$ of an applied voltage to a "write in" cathode $K_W$. Parts indicated by marks X in the waveform $V_{KW}$ change depending on contents to be displayed. By applying the voltages of such waveforms, the point of light emission written in the writing cell $a_w$ is sequentially transferred to the cells $a_1$, $a_2$, $a_3$, $a_4$ . . . zigzag and advances in the principal self-transfer direction (a direction shown by an arrow in FIG. 6) as a whole.

As also seen from FIG. 7, according to this invention, the electrodes being substantially parallel to the principal self-transfer direction and the electrodes intersecting therewith are respectively driven by the waveforms of at least two phases at the transfer (provided that the writing electrode shall now be involved in the number of phases).

Figure 8A:
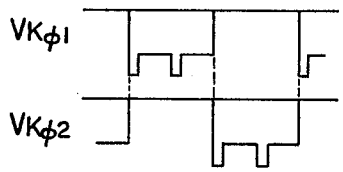
Figure 8B:
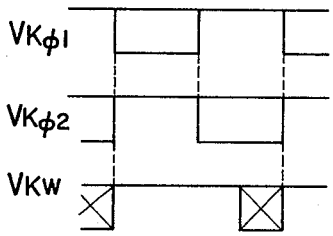
Figure 8C:
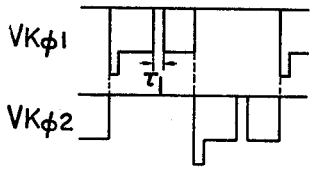
Figure 8D:
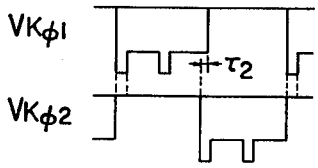

The waveforms illustrated in FIG. 7 are of a typical case, and different waveforms of the applied voltages $V_{K\phi 1}$ and $V_{K\phi 2}$ are shown in FIG. 8(a). In this case, when the difference between the minimum light-emission voltage $x_W$ and the minimum light-emission maintaining voltage $x_E$ of the cell adjoining the cell which is emitting light, that is, the value of $(x_{W1} - x_E)$ is small, it is possible to make $E_{K2} = E_{K1}$ and $E_{A2} = E_{A1}$ as illustrated in FIG. 8(*b*). Herein, $V_{KW}$ is put into $E_{K1} = E_{K2}$ when the cell is caused to emit light, and it is made below the aforecited value or made zero when the cell is not caused to emit light. When the degree of coupling between the cells $a_w$ and $a_1$, between the cells $a_4$ and $a_5$, between the cells $a_8$ and $a_9$, between the cells $a_{12}$ and $a_{13}$ . . . is particularly high, the operation of the transfer between these cells is sometimes conducted more stably in such a way that at $\tau_1$ sec after the applied voltage of the preceding cell has been made below the minimum light-emission maintaining voltage $x_E$, the voltage of the succeeding cell is made at least the minimum light-emission starting voltage $x_{W1}$ of the cell adjoining the cell which is emitting light. The waveforms of the applied voltages to the cathodes in that case are ilustrated in FIG. 8(*c*). When the degree of coupling between the cells $a_2$ and $a_3$, between the cells $a_6$ and $a_7$, between the cells $a_{10}$ and $a_{11}$, . . . is low, the operation of the transfer between these cells is conducted more stably in such a way that before making the applied voltage of the preceding cell below the value $x_E$, the voltage of the succeeding cell is made at least the value $x_{W1}$. The applied voltages to the cathodes in that case are illustrated in FIG. 8(*d*). Of course, these driving methods can be adopted in combination.

Figure 9:
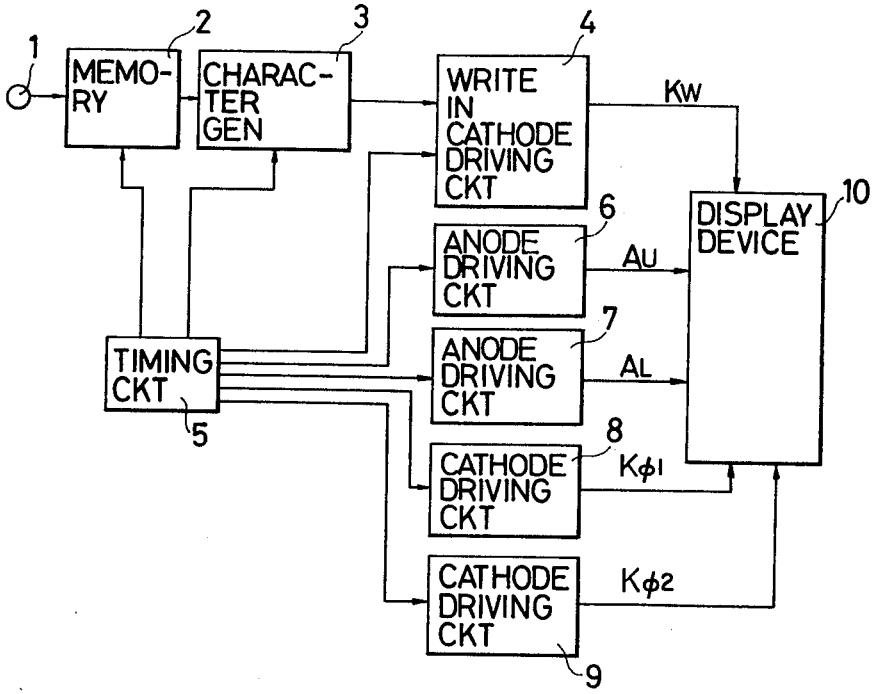
FIG. 9 is a block diagram showing an example of a driving circuit arrangement in the display device of this invention.

FIG. 9 is a block diagram showing an example of a driving device in the case of performing the character display by the use of the display device of the construction of the cells and the electrodes as shown in FIG. 6. An input signal applied to a terminal 1 is stored in a memory 2, and is thereafter converted into an information indicative of an actual character by a character generator 3. It is delivered to the "write in" cathode line $K_W$ of the display device 10 via a "write in" cathode driving circuit 4. In this case, the part indicated by the mark X in the waveform $V_{KW}$ shown in FIG. 7 changes in dependence on the output of the character generator 3. Anode driving circuits 6 and 7 and cathode driving circuits 8 and 9 generate the voltage waveforms $V_{AU}$, $V_{AL}$, $V_{K\phi 1}$ and $V_{K\phi 2}$ shown in FIG. 7 in dependence on signals supplied from a timing circuit 5, respectively.

Figure 10:
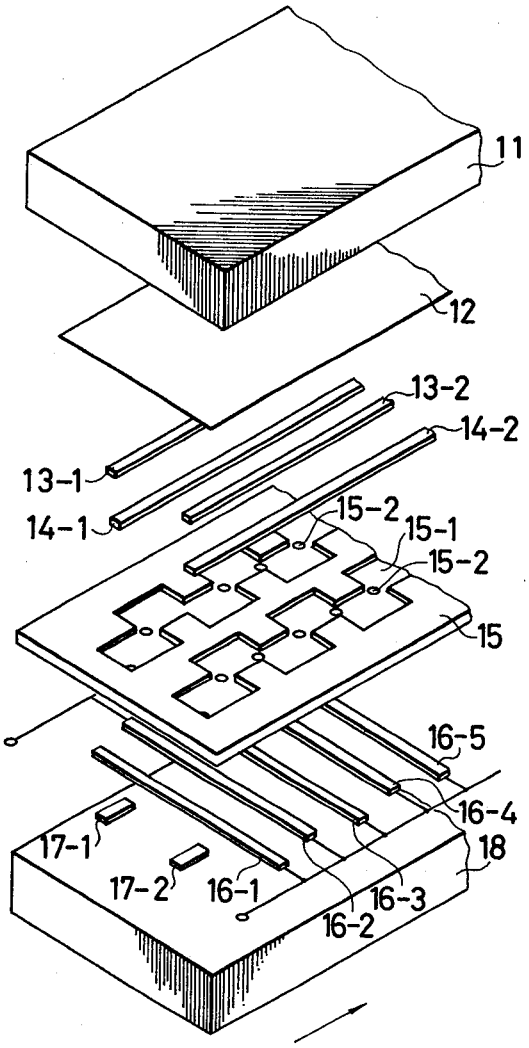
FIGS. 10 and 12 are perspective views each showing the construction of an embodiment of the display device of this invention.

FIG. 10 shows an embodiment of the construction of the display device of this invention at the time when, on the basis of the electrode arrangement shown in FIG. 6, the first and second anode electrodes $A_U$ and $A_L$, and the cathode electrodes $K_1$, $K_2$, $K_3$ . . . are respectively arranged on identical planes. The self-transfer type display device shown in FIG. 10 has two arrays of cells.

The display device of FIG. 10 is composed of a transparent insulating material 11, a phosphor sheet 12, first anode electrodes 13-1 and 13-2, second anode electrode 14-1 and 14-2, a spacer 15 which is provided with grooves 15-1 of joined rectangles and through-holes 15-2, cathode electrodes 16-1, 16-2 . . . , "write in" cathode electrodes 17-1 and 17-2, and an insulating substrate 18. The cells are tightly closed by sealing therein a gas whose principal constituent is a rare gas such as xenon.

The discharge occurs between the cathode electrodes 16, 17 and the first anode electrodes 13 or the second anode electrodes 14 through the penetrating holes 15-2 of the spacer 15. In this case, the coupling between the cells is done by the grooves 15-1 formed in the spacer 15. In the case of sealing Ne gas or the like and exploiting the visible light emission of the gas itself, the phosphor sheet 12 is unnecessary. With the construction as shown in FIG. 10, all of the electrodes 13, 14, 16 and 17, the spacer 15 and the phosphor sheet 12 can be efficiently fabricated by the thick film printing.

Now, description will be made of an embodiment in the case where the electrodes $A_U$ and $A_L$ are arranged on planes different from each other.

Figure 11A:
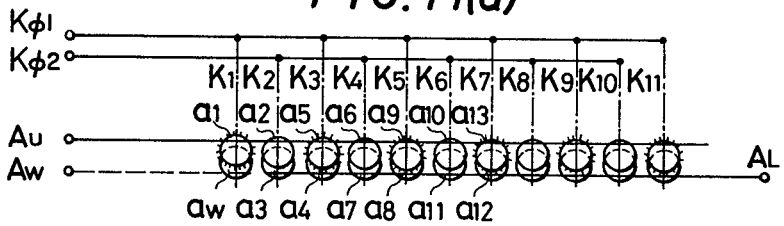
Figure 11B:
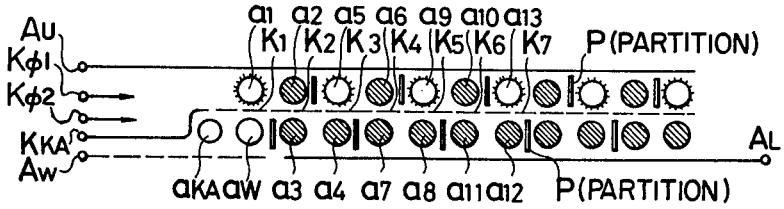

FIGS. 11(*a*) and 11(*b*) are an explanatory view in which the upper and lower cells are illustrated on the sheet of paper with a slight shift relative to each other and to which an electrode arrangement is added, and a sectional view in the vertical direction, respectively. In this case, the second anode electrodes $A_L$ and a "write in" anode electrode $A_W$ are disposed on the lower side, the cathode electrodes $K_1$, $K_2$, $K_3$ . . . in the middle, and the first anode electrodes $A_U$ on the upper side. Likewise to the case of FIG. 6, ionization coupling means are provided between the cells $a_w$ and $a_1$, the cells $a_1$ and $a_2$, the cells $a_2$ and $a_3$, the cells $a_3$ and $a_4$, . . . In the embodiment of FIGS. 11(*a*) and 11(*b*), in order to raise the response speed of the writing cell $a_w$, a "keep alive" cell $a_{KA}$ which is coupled with the cell $a_w$ ionization-wise is provided. When the transfer cells are stacked in two stages as in the present embodiment, the proportion of occupying areas of the display cells on the surface to be viewed (in this case, the upper surface) can be enhanced.

Figure 12:
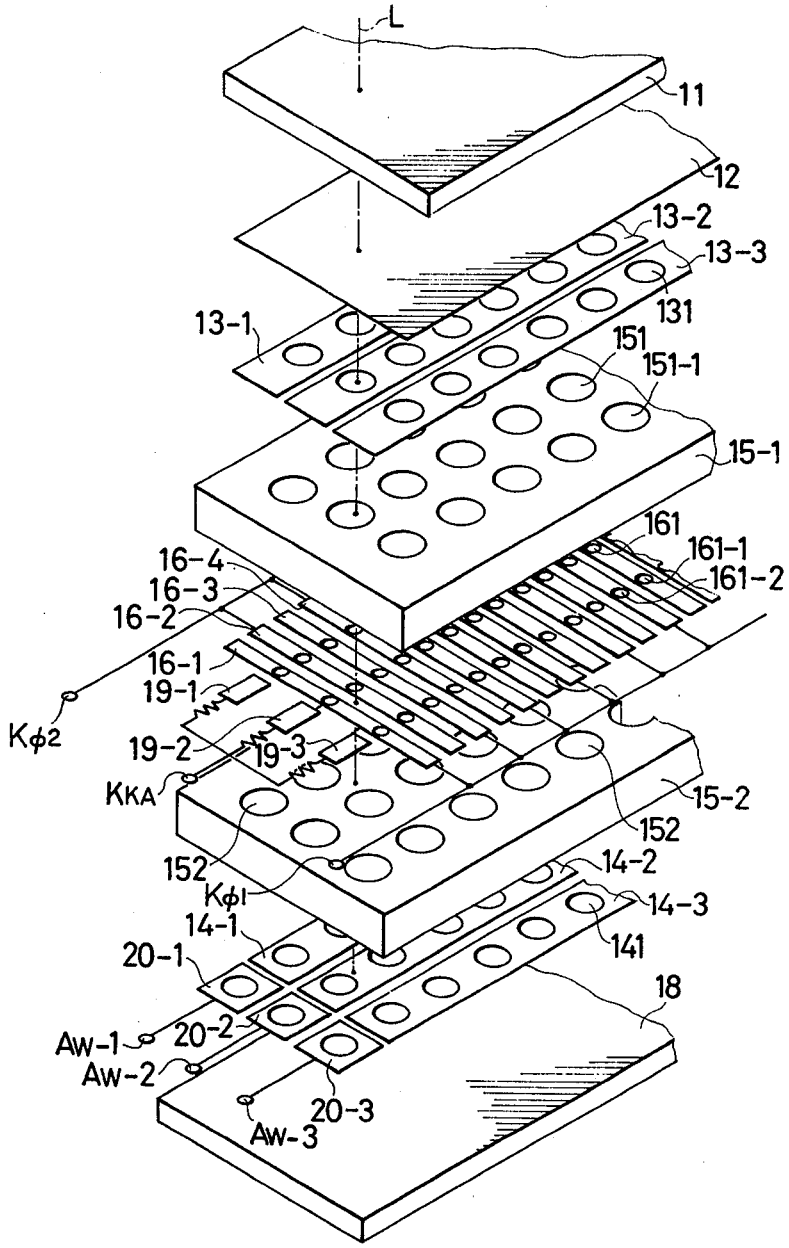

FIG. 12 shows a display device based on the construction of the cells and the electrodes as shown in FIG. 11(*a*) and 11(*b*), by taking as an example a case where the cells are of three arrays. The display device shown in FIG. 12 is composed of a transparent insulating material 11, a phosphor sheet 12, first anode electrodes ($A_U$) 13-1, 13-2 and 13-3, a first spacer 15-1, cathode electrodes ($K_{\phi 1}$, $K_{\phi 2}$) 16-1, 16-2 . . . , "keep alive" cathode electrodes ($K_{KA}$) 19-1, 19-2 and 19-3, a second spacer 15-2, second anode electrodes ($A_L$) 14-1, 14-2 and 14-3, "write in" anode electrodes ($A_{W\text{-}1}$, $A_{W\text{-}2}$, $A_{W\text{-}3}$) 20-1, 20-2 and 20-3, and an insulating substrate 18. The cells are tightly closed by sealing therein a gas whose principal constituent is a rare gas such as xenon.

Here, the pitch of the cathode electrodes 16 is set at a half of each of the pitches of the first anode electrodes 13, the second anode electrodes 14, and through-holes 151 and 152 of the respective first and second spacers 15-1 and 15-2. Through-holes 131 of the first anode electrodes and the through-holes 151 of the first spacer, and through-holes 141 of the second anode electrodes and the through-holes 152 of the second spacer are respectively set so that the corresponding through-holes may be coaxial. In addition, the through-holes 151 of the first spacer and the through-holes 131 of the first anode electrodes are set so as to oppose to the through-holes 152 of the second spacer and the through-holes 141 of the second anode electrodes under the state under which they shift to each other by the pitch of the cathode electrodes in the principal selt-transfer direction as illustrated by a one-dot chain line L.

In the present embodiment, the ionization coupling between the upper group of cells ($a_1$, $a_2$, $a_5$, $a_6$, $a_9$, $a_{10}$ . . . in FIG. 11(*a*) and 11(*b*)) and the lower group of cells ($a_w$, $a_3$, $a_4$, $a_7$, $a_8$ . . . in FIGS. 11(*a*) and 11(*b*)) is done by providing through-holes 161 in the cathode electrodes. The ionization coupling between the cells of the upper group of cells (between $a_1$ and $a_2$, $a_5$ and $a_6$, $a_9$ and $a_{10}$, . . . in FIG. 11(*a*) and 11(*b*)) and between the cells of the lower group of cells (between $a_{KA}$ and $a_W$, $a_3$ and $a_4$, $a_7$ and $a_8$, . . . in FIGS. 11(*a*) and 11(*b*)) is achieved by disposing the respective two cells in the identical hole of the spacer.

That is, the through-hole 151-1 provided in the spacer 15-1 hold in common the through-hole 161-1 and the through-hole 161-2 provided in the cathode electrodes, and it acts as a coupling hole which causes the cell on the upper side and the cell on the lower side to produce the discharge and which also transfers the discharge.

In the panel thus constructed, the pitch of the display cells in the principal self-transfer direction coincides with the pitch of the holes of the first or second spacer, and becomes double the pitch of the holes of the cathodes. In consequence, the display dot pitch decreases to ½ as compared with that in the prior-art device shown in FIG. 1 (the display dot pitch is four times as large as the cathode pitch). By making the cathode pitch 0.5 mm or less and employing the structure of FIG. 10 or FIG. 12, the display dot pitch can be made 1 mm or less, and the display suitable for the desk top type becomes possible.

When, as each cathode electrode in FIG. 12, an unperforated narrow metal sheet or a fine metal wire is used instead of the perforated broad metal sheet, the cathode electrode pitch can be made still smaller, and the display dot pitch can be made smaller accordingly. The coupling between the upper group of cells and the lower group of cells in this case is effected through clearances which are formed on both the sides of the cathodes.

Figure 13:
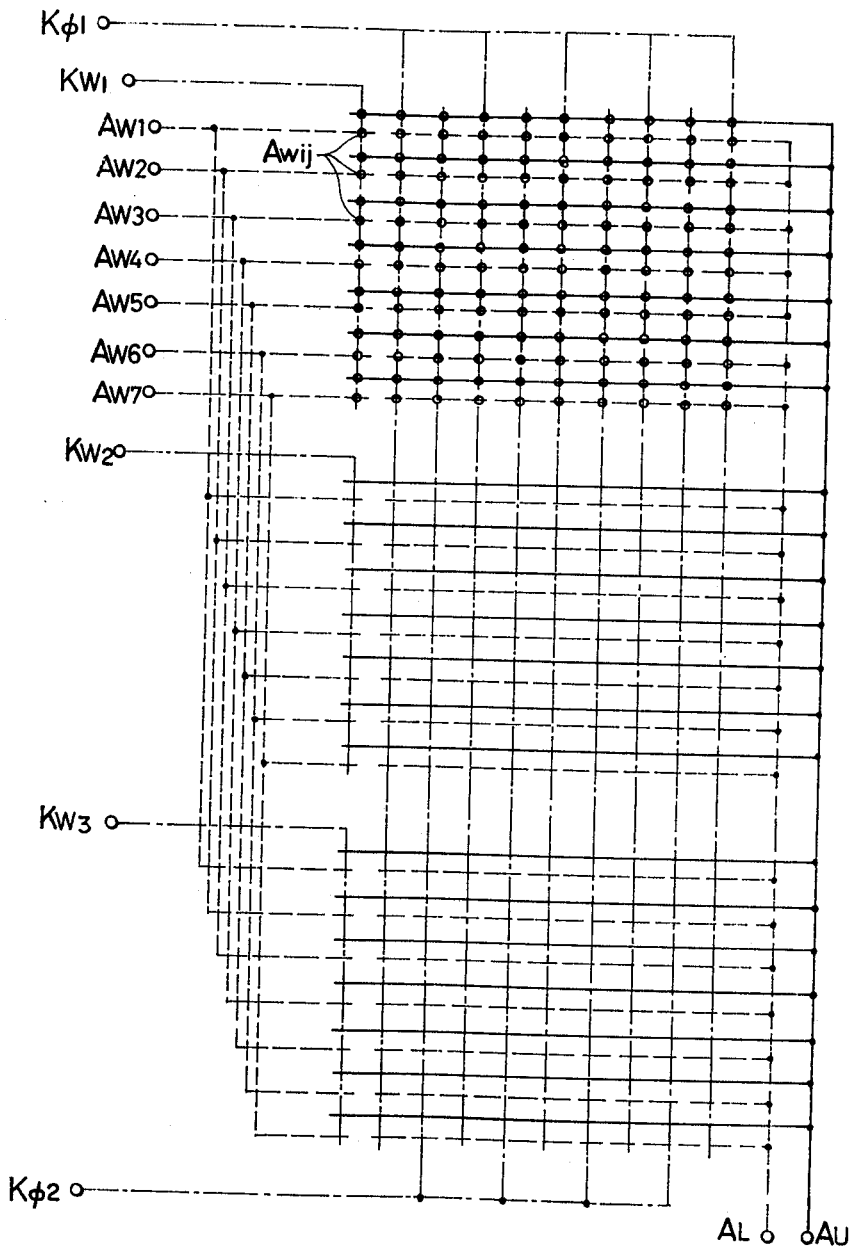

In the case of performing the display of characters etc. of a large number of lines, the number of electrodes to be derived from the panel can be further reduced by employing means for decreasing lead-out electrodes for the writing cells $a_{Wi}$ ($i = 1, 2, \ldots$) as will be stated hereunder. By way of example, an electrode arrangement in the case of performing the character display of 3 lines is shown in FIG. 13. In the figure, only a group of cells into which information are written by the "write in" cathode electrode $K_{W1}$ are illustrated, and groups of cells by the "write in" cathode electrodes $K_{W2}$ and $K_{W3}$ are not illustrated.

Figure 14:
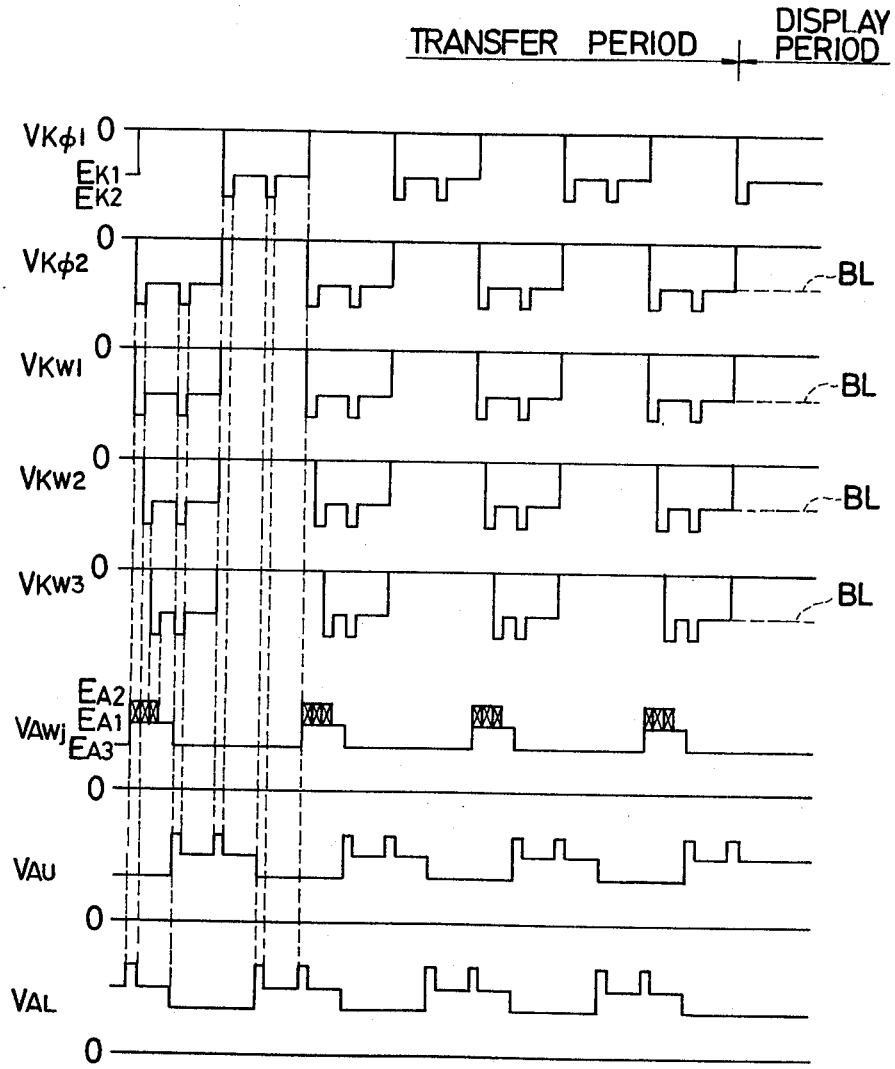

In this case, the writing cells $A_{Wij}$ are constructed by the writing cathode electrodes $K_{Wi}$ ($i = 1, 2$ and 3) and the writing anode electrodes $A_{Wj}$ ($j = 1, 2, 3, \ldots$ and 7). By connecting the electrodes of the writing cells in the form of a matrix in this manner, the number of lead-out electrodes becomes a half or less as compared with that in the case of the fundamental construction of FIGS. 11(*a*) and 11(*b*). An example of waveforms at this time is shown in FIG. 14. Desired writing can be carried out by shifting the writing times of the writing cells $A_{W1j}$, $A_{W2j}$ and $A_{W3j}$.

By way of example, the number of lead-out electrodes required in the case of performing a character display wherein 32 characters × 8 lines = 256 characters and 1 character = 5 × 7 dots is 216 in a conventional XY-matrix panel and is 60 in the panel employing the fundamental construction of FIGS. 11(*a*) and 11(*b*), whereas it is 19 in the panel employing the construction of FIG. 13. In this manner, according to the present embodiment, it becomes possible to make the number of electrodes below one-tenth without rendering the dot pitch at the display very large. Therefore, a bright display device which is suitable for the desk top type and in which the numbers of driving circuits and connections are small is provided.

By holding both the voltages $V_{K\phi 1}$ and $V_{K\phi 2}$ at $E_{K1}$ at the display as illustrated by broken lines BL in the waveforms of FIG. 7 and FIG. 14, it is possible to simultaneously use two cells (for example, the cells $a_W$ and $a_1$, $a_4$ and $a_5$, $a_8$ and $a_9$, $a_{12}$ and $a_{13}$, . . . in FIG. 6) for the display. By alternately lighting up the two cells ($a_W$ and $a_1$, $a_4$ and $a_5$, $a_8$ and $a_9$, $a_{12}$ and $a_{13}$, . . . ) at the display, it is possible to establish a state in which apparently the two dots are emitting light. Even when the cathodes are changed to read as anodes and the anodes as cathodes in the above description, substantially the same operation is attained.

Although, in the above, the display panels employing the optical elements have been set forth, this invention is not restricted thereto. For example, this invention is also applicable to an image pickup panel or a memory panel employing charge coupled devices (the so-called CCD's). In sum, if (1) elements to be employed have the memory function of at least two values and (2) coupling means can be provided between the elements, a panel to which this invention is applied can be fabricated.

We claim:

1. A self-transfer display device, comprising:

a first electrode group which consists of a plurality of electrodes being substantially parallel to one another, a second electrode group which consists of a plurality of electrodes lying in cubic crossing to the electrodes of said first electrode group and being substantially parallel to one another, optical elements which have a memory function and which are respectively provided at points of the cubic crossing between the electrodes of said first electrode group and said second electrode group, means for coupling light emission and means for decoupling the light emission as are alternately provided at every $k (k \geqq 2)$ adjacent optical elements disposed along each of said electrodes of said first electrode group, and means for coupling the light emission as is provided between the optical elements disposed along $n$ ($n \geqq 2$) adjacent electrodes of said first electrode group, whereby the state of light emission occurring in the optical elements advances in a predetermined direction while shifting zigzag.

2. A self-transfer display device, comprising:

a first group of $m$ (which is an integer satisfying $m \geqq 2$) electrodes, a second group of $l$ (which is an integer satisfying $l \geqq 2$) electrodes intersecting with said first group of electrodes, optical elements which have a memory function and which are arranged at points of the intersection between said first group of electrodes and said second group of electrodes, means for decoupling light emission as is provided at every predetermined number of optical elements connected to the electrodes of said first group, said means weakening coupling of the state of light emission occurring in the adjacent optical elements, means provided between the optical elements in order to effect ionization coupling between said optical elements existent between the light-emission decoupling means, and means provided between the optical elements in order to effect ionization coupling between said optical elements connected to the adjacent electrodes of said first group, whereby the state of light emission between the optical elements advances in a predetermined direction while shifting zigzag.

* * * * *